US008322087B1

(12) United States Patent
Lascano

(10) Patent No.: US 8,322,087 B1
(45) Date of Patent: Dec. 4, 2012

(54) MODULAR LANDSCAPE BORDER APPARATUSES AND SYSTEMS

(76) Inventor: Eduardo L. Lascano, Fontana, CA (US)

( * ) Notice: Subject to any disclaimer, the term of this patent is extended or adjusted under 35 U.S.C. 154(b) by 0 days.

(21) Appl. No.: 13/431,564

(22) Filed: Mar. 27, 2012

(51) Int. Cl.
*E02D 27/00* (2006.01)

(52) U.S. Cl. ..... 52/102; 52/578; 47/33; 404/7

(58) Field of Classification Search ..... 52/102, 52/578; 47/33; 404/7, 8
See application file for complete search history.

(56) References Cited

U.S. PATENT DOCUMENTS

| | | | | | |
|---|---|---|---|---|---|
| 342,690 | A | | 5/1886 | Flatau | |
| 348,598 | A | * | 9/1886 | Strickland | 52/102 |
| 2,436,593 | A | | 2/1948 | Moselowitz | |
| 2,713,751 | A | | 7/1955 | Hendrixson | |
| 2,782,561 | A | * | 2/1957 | Smith | 47/21.1 |
| 3,619,944 | A | * | 11/1971 | Matvey | 47/33 |
| 3,636,830 | A | * | 1/1972 | Watts | 404/2 |
| 3,724,128 | A | * | 4/1973 | Tabone | 47/33 |
| 3,841,022 | A | * | 10/1974 | Thodos | 47/33 |
| 3,945,747 | A | | 3/1976 | Cruz | |
| 4,642,938 | A | * | 2/1987 | Georges et al. | 47/2 |
| 4,663,883 | A | * | 5/1987 | Hilliard et al. | 47/33 |
| 4,762,438 | A | | 8/1988 | Dewing | |
| 4,976,063 | A | * | 12/1990 | Young | 47/33 |
| 5,178,369 | A | * | 1/1993 | Syx | 256/32 |
| D353,214 | S | * | 12/1994 | DeGroot | D25/164 |
| 5,377,447 | A | * | 1/1995 | Fritch | 47/33 |
| 5,661,925 | A | * | 9/1997 | MacMaster | 47/32.4 |
| 5,772,357 | A | | 6/1998 | Evans | |
| 5,852,895 | A | | 12/1998 | Sinanan | |
| 5,918,411 | A | * | 7/1999 | Hadrava | 47/21.1 |
| 5,926,999 | A | | 7/1999 | Vernon | |
| 6,099,942 | A | * | 8/2000 | Yakushinji | 428/192 |
| 6,138,405 | A | * | 10/2000 | Matz | 47/33 |
| 6,202,358 | B1 | | 3/2001 | Janesky | |
| 6,230,451 | B1 | * | 5/2001 | Stoller | 52/169.1 |
| 6,324,796 | B1 | * | 12/2001 | Heath | 52/177 |
| 6,767,159 | B2 | | 7/2004 | Jones | |
| 6,929,234 | B2 | | 8/2005 | Takagi | |
| 6,931,798 | B1 | * | 8/2005 | Pocai | 52/102 |
| 7,047,697 | B1 | * | 5/2006 | Heath | 52/177 |
| 7,111,435 | B2 | | 9/2006 | Flores | |
| 7,540,110 | B2 | | 6/2009 | Al-Sulaiman et al. | |
| 7,596,903 | B1 | | 10/2009 | Flanagan | |
| 2002/0157325 | A1 | * | 10/2002 | Domanico | 52/35 |
| 2005/0016063 | A1 | | 1/2005 | Shen | |
| 2005/0204662 | A1 | * | 9/2005 | Showers et al. | 52/263 |
| 2009/0223121 | A1 | * | 9/2009 | Jones | 47/33 |

(Continued)

FOREIGN PATENT DOCUMENTS

| | | |
|---|---|---|
| CA | 2631926 | 11/2009 |

(Continued)

*Primary Examiner* — Brian Glessner
*Assistant Examiner* — Adriana Figueroa
(74) *Attorney, Agent, or Firm* — Marcus N. DiBuduo

(57) ABSTRACT

Modular landscape borders can include curb and planter sections, and adjacent modular borders can engaged to each other via coupling members. The curb section can include channels for receiving electrical and/or irrigational devices. The curb section can include a face having openings for receiving illumination devices and/or irrigation devices. The planter section can include irrigation drainage and a conduit for receiving irrigation tubing and/or for distributing irrigation water. Openings can be provided for receiving retaining spikes for securing the modular border to the ground. Supporting structures can provide rigidity and/or structural support to the curb and/or the planter. The modular border may include partition lines for division into smaller partitions.

30 Claims, 7 Drawing Sheets

U.S. PATENT DOCUMENTS

2010/0226720 A1 9/2010 Meert et al.

FOREIGN PATENT DOCUMENTS

| | | |
|---|---|---|
| FR | 2746578 | 10/1997 |
| GB | 2108183 | 5/1983 |
| GB | 2228758 | 9/1990 |
| GB | 2273117 | 6/1994 |
| GB | 2357416 | 6/2001 |
| WO | 2005110061 | 11/2005 |

* cited by examiner

MODULAR LANDSCAPE BORDER APPARATUSES AND SYSTEMS

BACKGROUND OF THE INVENTION

1. Field of the Invention

The present invention concerns landscape bordering apparatuses and systems. More specifically, some embodiments of the present invention pertain to apparatuses and systems that are modular and include a curb and a planter.

2. Background

In some landscape designs, it may be desirable to place a curb between two distinct sections, such as a lawn section and a garden section. Inclusion of a curb between the sections not only adds aesthetic appeal but prevents overgrowth of landscaping from one section into another. For example, a curb can be placed between a lawn section and a shrub section to contain and prevent encroachment of the lawn.

Some conventional curbs are formed from concrete or stone paving blocks which are placed around an edge of a landscape section and arranged end-to-end. Some other conventional curbs are formed from concrete, which can be poured into preset forms or which can be made by a continuous process. However, the initial installation and occasional repair of damaged sections of conventional curbing comprising concrete or stone is expensive.

In some landscape designs, it may also be desirable to provide one or more planters for containing flowers, small herbs, and the like. Some conventional planters are ceramic or clay pots that contain flowers which can be placed throughout the landscaping. Some other conventional planters include raised sections of soil that are bounded by concrete or stone blocks. Some other conventional planters include concrete blocks having one or more central openings, which can be filled with potting soil and flowers.

Conventional curbing and borders employing concrete or other heavy and/or permanent material have several disadvantages. In one aspect, large vehicles are generally required to transport materials and equipment to the installation site, which in addition to potentially damaging existing landscaped areas (such as existing grass and flowers), has the potential for damaging underground utilities such as irrigation lines. Transportation of the material and equipment also requires significant fuel consumption throughout the whole supply chain: from the supplying company's material yards, to the supply yards, to the job site. Operation of conventional installation equipment (such as concrete mixers, sod cutters, continuous curb forming machines, etc.) is noisy also requires significant fuel consumption.

Conventional concrete curbing can take up to 30 days to fully cure, and during this time cannot be fully used as curbing is most vulnerable to cracking, sprawling, or chipping during this time. It can be appreciated that if the concrete curbing is damaged (including during the curing stage or otherwise) or the consumer desires to make changes, significant effort must be expended to remove and/or replace the curbing. Conventional curbing and borders also require significant manpower (which increases the total cost to the consumer and introduces potentials for injury).

It is therefore desirable for apparatuses and systems which include modular landscape border sections that include curbing and integral planting sections and which may be easily installed, removed, or replaced.

SUMMARY OF THE INVENTION

Embodiments of the present invention relate to novel landscape border apparatuses and systems. More specifically, disclosed are modular borders that include a curb and a planter.

In some aspects, the invention concerns a modular landscape border that can include a curb, a planter, a conduit, and one or more coupling members. The curb can have a front wall, a face, and a back wall, and the curb face can be between a top portion of the curb front wall and a top portion of the curb back wall. The planter can have a back wall and a bottom wall, and the planter bottom wall can be between a bottom portion of the curb back wall and a bottom portion of the planter back wall. The conduit can be at top portion of the planter back wall. The coupling members can be on the curb and/or the planter. In some embodiments, the curb can include a channel extending therethrough.

In some advantageous embodiments, the border can include at least two coupling members. In some embodiments, the first coupling member can include a female coupling member. In some other embodiments, the first coupling member can include a male coupling member. In some embodiments, the second coupling member can include a male coupling member. In some embodiments, the male coupling member and the female coupling member can have complementary features. In some implementations, the male coupling member and/or the female coupling member can have barbed features.

The border can be divided into one or more partitions and/or cut to a desired dimension. In some advantageous embodiments, the border can include a partition line about tangential to the curb and the planter. The border can be separated into two partitions along the partition line. In some embodiments, one or more coupling members can be adjacent to the partition line and on the curb and/or the planter.

The border can include wall supporting structures. In some embodiments, the planter can include one or more planter supports engaged with the planter back wall and the curb back wall and/or planter bottom wall. In some embodiments, the curb can include one or more bottom support panels engaged with the curb front wall and the curb back wall. In some embodiments, the curb can include one or more curb face supports engaged with the curb face and the curb back wall and/or a bottom support panel.

The border can include retaining and draining features. In some embodiments, the border can include one or more openings in the planter bottom wall. In some implementations, the opening can be a hole for receiving a retaining spike therethrough. In some other implementations, the opening can be a drain. In some embodiments, the border can include a lip with a hole therein for receiving a retaining spike therethrough. In some implementations, the lip can be at a bottom portion of the curb front wall.

The border can include openings in the curb face for receiving devices therethrough. In some implementations, the openings can be for receiving illumination devices. In some implementations, the openings can be for receiving irrigation devices. The border can include covers, which may be in the form of hinged covers or slideable covers, in the opening for visually obscuring the openings. In some implementations, the openings may be in the form of "punch-out" or "knock-out" scoring on the curb face.

In some aspects, the invention concerns a modular landscape border system that can include at least two modular landscape borders which are adjacently secured. In some embodiments, each border can include a curb, a planter, a conduit, and a coupling member. The curb can have a front wall, a face, and a back wall, and the curb face can be between a top portion of the curb front wall and a top portion of the curb back wall. The planter can have a back wall and a bottom wall, and the planter bottom wall can be between a bottom portion of the curb back wall and a bottom portion of the planter back wall. The coupling member can be on the curb and/or the planter. Advantageously, the first border coupling member can be engaged to the second border coupling member to secure the first border adjacent to the second border.

In some embodiments, the first border coupling member can include a female coupling member. In some embodiments, the second border coupling member can include a male coupling member. The female coupling member and the male coupling member can have complementary features. In some implementations, the female coupling member and/or the male coupling member can have barbed features.

In some embodiments, the second border coupling member also can include a female coupling member. In some embodiments, the system can further include a male coupling member adapter having a first end and a second end. The first end can have features complementary to features of the first border female coupling member, and the second end can have features complementary to features of the of the second border female coupling member. In some implementations, the male coupling member adapter, the first border female coupling member, and/or the second border female coupling member can have barbed features.

In some embodiments, each the first border coupling member and the second border coupling member can include male coupling members. In some embodiments, the system can further include a female coupling member adapter having a first end and a second end. The first end can have features complementary to features of the first border male coupling member, and the second end can have features complementary to features of the second border male coupling member. In some implementations, the female coupling member adapter, the first border male coupling member, and/or the second border male coupling member can have barbed features.

In some aspects, the invention concerns a modular landscape border system that can include: (i) a curb, (ii) a planter, (iii) at least one conduit, (iv) at least one planter support, (v) at least one bottom support panel, (vi) at least one curb face support, (vii) a first coupling member, (viii) a second coupling member, and (xi) a coupling member adapter. The curb can be defined by a front wall, a curb face, and a curb back wall, and the curb face can be between a top portion of the curb front wall and a top portion of the curb back wall. The planter can be defined by a back wall and a bottom wall, and the planter bottom wall can be between a bottom portion of the curb back wall and a bottom portion of the planter back wall. The planter bottom wall can include at least one serpentine drain therein.

In some implementations, the conduit can be at a top portion of the planter back wall. In some implementations, the planter support can be engaged with the planter back wall and the curb back wall. In some implementations, the bottom support panel can be engaged with the curb front wall and the curb back wall. In some implementations, the curb face support can be engaged with the curb face and the curb back wall and/or the bottom support panel.

In some implementations, the first coupling member can be engaged with a first side of one of the curb and/or the planter. In some implementations, the second coupling member can be engaged with a second side of the curb and/or the planter. In some embodiments, the coupling member adapter can include a first end having features complementary to features of the first coupling member, and a second end having features complementary to features of the second coupling member.

It is to be appreciated that apparatuses and systems in accordance with embodiments of the present invention enable economic landscape bordering which integrates curbing and planting sections. In some embodiments, the invention enables a plurality of modular border sections which integrate conduit and/or channels for receiving electrical and/or irrigational devices therethrough.

It is also to be appreciated that apparatuses and systems in accordance with some embodiments of the present invention are lightweight and may be installed, removed, replaced, and reconfigured without the use of specialized equipment and/or labor These and other objects, advantages and features of the invention, together with the organization and manner of operation thereof, will become apparent from the following detailed description when taken in conjunction with the accompanying drawings, wherein like elements have like numerals throughout the several drawings described herein.

DETAILED DESCRIPTION OF PREFERRED EMBODIMENTS

The invention, in its various aspects, will be explained in greater detail below. While the invention will be described in conjunction with several exemplary embodiments, the exemplary embodiments themselves do not limit the scope of the invention. Similarly, the exemplary illustrations in the accompanying drawings, where like elements have like numerals, do not limit the scope of the exemplary embodiments and/or invention. Rather the invention, as defined by the claims, may cover alternatives, modifications, and/or equivalents of the exemplary embodiments.

Figure 1:
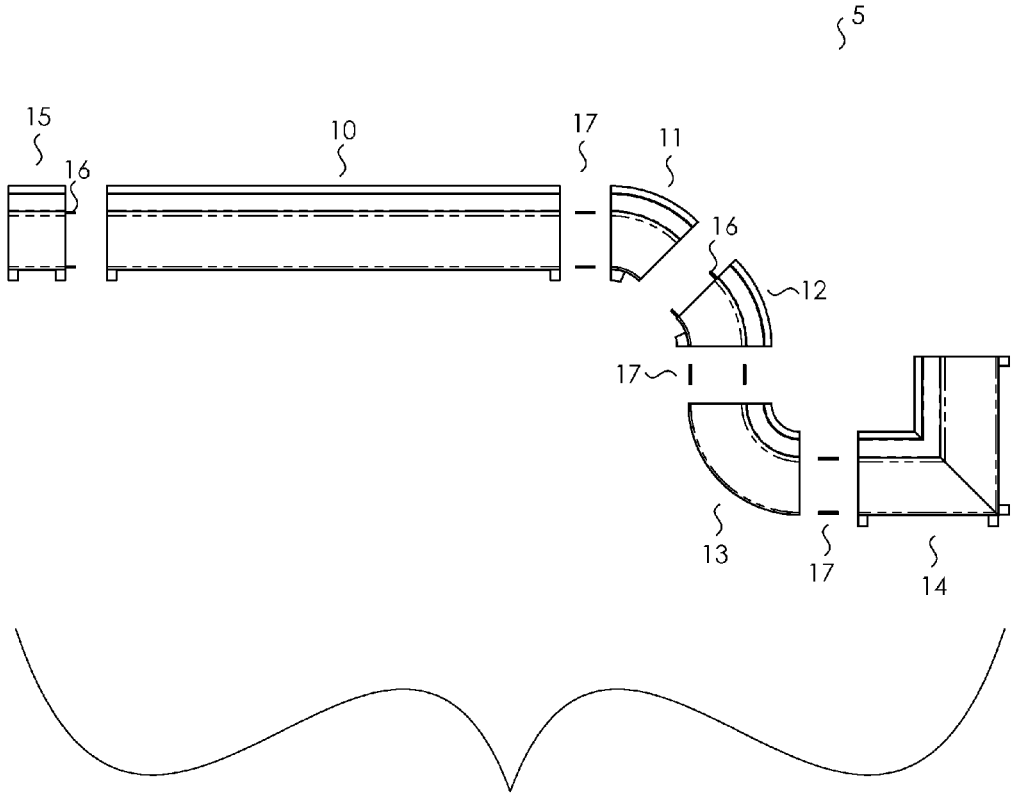
FIG. 1 is an exploded diagram illustrating an exemplary landscape border system in accordance with some embodiments of the present invention.

Referring now to the exemplary illustration of FIG. 1, and without limitation, landscape border system 5 can include a plurality of modular borders that can be engaged to each other through one or more coupling members. In some implementations, the modular borders may have a rectangular shape (such as modular border 10), an arched shape (such as modular border 11 and modular border 12), a circular or semicircular shape (such as modular border 13), a rectangularly shaped corner (such as modular border 14), or a square shape (such as modular border 15). However, it is to be appreciated that other shapes are contemplated in accordance with some embodiments of the present invention. For example, and without limitation, the modular border may have an "S" shape or a "U" shape, or may form a complete circle, square, rectangle, or oval. In some implementations, landscape border systems can include a plurality of modular borders forming a closed shape (for example, and without limitation, such as a ring, circle, or a square) which may be placed around a tree. It is to be appreciated that such systems help to retain water and mulch and advantageously provide a planter section in which flowers may be placed.

In some embodiments, a system can include multiple similarly shaped modular borders having different lengths and/or dimensions enabling a landscape border that can be custom fit to any landscape dimension. For example, and without limitation, rectangularly shaped modular borders (such as modular border 10) can be provided in lengths of one foot, two feet, or four foot options. In some other examples, circular or semi-circular shaped modular borders (such as modular border 13) can be provided in one foot radius, two feet radius, and four feet radius options. It is to be appreciated that, as one example, a landscape section having an edge measuring ten feet may be bordered by two (2) four foot rectangular modular borders and one (1) two foot rectangular modular border, or three (3) three foot rectangular modular borders and one (1) one foot rectangular modular borders. Other sizes are contemplated in accordance with some embodiments of the present invention.

In some embodiments, each modular border may be engaged to other modular borders on side ends thereof. For example, and without limitation, modular border 11 may be engaged to modular border 10 and modular border 12. However, in some embodiments, a landscape system can additionally include end piece modular borders engaged to another modular border only on one side thereof. For example, and without limitation, end piece modular border 15 may be engaged only to modular border 10.

As above, the modular borders may be engaged to one another with one or more coupling members. In some embodiments, the modular borders may comprise the coupling members. For example, and without limitation, coupling members 16 may be provided on one or more sides of the modular borders. However, in some embodiments, the coupling members may be separate from the modular borders. For example, and without limitation, coupling members 17 may be in the form of an adapter.

In some embodiments, a modular border may be engaged to adjacent modular borders through integrally formed coupling members (for example, and without limitation, modular border 15 may be engaged to modular border 10 through coupling members 16). However, as discussed below, in some embodiments, a modular border may comprise separate coupling member adapters. Thus, in some embodiments, a modular border may be engaged to adjacent modular borders through separate coupling member adapters (for example, and without limitation, modular border 13 may be engaged to each modular border 12 and modular border 14 through coupling member adapters 17). In some embodiments, a modular border may be engaged to adjacent modular borders through both integrally formed coupling members and separate coupling member adapters (for example, and without limitation, modular border 11 can be engaged to modular border 10 through coupling member adapters 17 and to modular border 12 through coupling members 16). It is to be appreciated that other combinations are contemplated in accordance with some embodiments of the present invention.

Exemplary Modular Landscape Borders

In some embodiments, a modular border can include a curb, a planter, and at least one coupling member. Referring now to the exemplary illustration of FIGS. 2-4, and without limitation, modular border 10 may include curb 20, planter 30, and coupling members (such as coupling members 41-46). Curb 20 may include curb front wall 21, curb face 23, and curb back wall 25. Planter 30 may include planter bottom wall 37 and planter back wall 39. Curb face 23 can have a first end that is adjacent to a top end of curb front wall 21 and a second end that is adjacent to a top end of curb back wall 25. Planter bottom wall 37 may have a first end that is adjacent to a bottom end of curb back wall 25 and a second end that is adjacent to a bottom end of planter back wall 39.

The curb can have an angled face, may be squared, may be rounded, or may have other shapes. In some embodiments, and as shown in the exemplary illustrations, the curb front wall may be about parallel to the curb back wall, and the curb front wall and the curb face may form an angle of between about 90 and 180 degrees. However, it is to be appreciated that the curb front wall and the curb face may form other angles in accordance with some embodiments of the present invention. For example, and without limitation, the curb front wall and the curb face may be about perpendicular giving the curb a squared shape. It is also to be appreciated that, in accordance with some embodiments of the present invention, the curb front wall may be coplanar with the curb face. For example, and without limitation, the curb front wall and the curb face may form a uniform angled surface between the bottom portion of the curb front wall and the upper portion of the curb back wall. In some other examples, the curb may be rounded or may form an arc with the curb front wall, the curb face, and/or the curb back wall being coaxial. Other arrangements of the curb front wall, curb face, and curb back wall are contemplated in accordance with some embodiments of the present invention.

It is to be appreciated that the curb face, the curb front wall, and/or the curb back wall may have decorative features on an outside surface thereof. In some embodiments, the curb face may have a smooth outer finish. In some other embodiments, the curb face may have a faux-stone, faux-concrete, or faux-wood finish. However, other finishes are contemplated in accordance with some embodiments of the present invention.

In some implementations, and as shown in the exemplary illustrations, the planter back wall may be about perpendicular to the planter bottom wall, the planter bottom wall may be about perpendicular to the curb back wall, and the planter back wall may be about parallel to the curb back wall. However, it is to be appreciated that in some embodiments, the curb back wall, the planter bottom wall, and/or the planter back wall may have different angular configurations. It is to be appreciated that flowers, herbs, vegetation, and the like along with soil may be placed in the planter, and that accordingly, in some embodiments the planter has a shape and dimensions suitable for receiving such landscaping.

In some embodiments, the curb and the planter may be unitarily formed. For example, and without limitation, curb front wall 21, curb face 23, curb back wall 25, planter bottom wall 37, and planter back wall 39 may be unitarily formed of plastic by an injection molding or an extrusion process. However, it is to be appreciated that the modular border or portions thereof may be formed of other materials and by other processes in accordance with some embodiments of the present invention. For example, and without limitation, the modular border or portions thereof can be formed of aluminum, ceramic, nylon, wood, or other materials, whether synthetic or natural.

In some other embodiments, one or more portions of the modular border may be separately formed and thereafter engaged. It is to be appreciated that a modular border having separately formed portions permits customized construction and design of landscape border systems, such as border systems with one or more curbs sections having various decorative features and/or shapes, and one or more planter sections having varying planter depths and planter back wall heights. In some examples, and without limitation, a modular border may include three portions that are engaged to each other through a snap fit connection: the first portion can include the curb front wall, the curb face, and the curb back wall (which may be unitarily formed); the second portion can include the planter bottom wall; and the third portion can include the planter back wall. In other examples, and without limitation, a first portion can include the curb front wall and the curb face (which may be unitarily formed) which can be engaged to a second portion which can include the curb back wall, the planter bottom wall, and the planter back wall (which may be unitarily formed). It is to be appreciated that other means of engaging the various portions are contemplated in accordance with some embodiments of the present invention. For example, and without limitation, the portions may be engaged by one or more hinges, bolts, screws, clamps, and the like.

The modular border can include one or more structural supports for the curb and/or the planter. In some embodiments, the planter can include supports to prevent deformation of the planter back wall when under load from landscaping soil deposited in the planter. For example, and without limitation, planter 30 can include one or more planter supports 59 engaged with planter back wall 39. In some implementations, planter support 59 can additionally be engaged to the planter bottom wall 37. In some other implementations, planter support 59 can be engaged to the curb back wall 25. In some other implementations, planter support 59 can be engaged to both the planter bottom wall 37 and curb back wall 25. It is to be appreciated that a modular border may comprise numerous planter supports 59 in various positions along planter 30 in accordance with some embodiments of the present invention. For example, and without limitation, a support can be provided on each side end of the planter and an additional support can be provided in a middle section of the planter. It is further to be appreciated that a modular border can include at least one planter support engaging the planter back wall and the planter bottom wall, at least one planter support engaging the planter back wall and the curb back wall, and at least one planter support engaging the planter back wall, the planter bottom wall, and the curb back wall. Additional configurations are contemplated in accordance with some embodiments of the present invention.

In some embodiments, the curb can include one or more structural supports to provide strength and rigidity to the curb. In some embodiments, the curb can include a bottom support panel engaged with the curb front wall and the curb back wall. For example, and without limitation, curb 20 can include bottom support panel 55. In some implementations, the bottom rigidity panel can include a single structural bar. In some other implementations, the bottom rigidity panel can comprise a honeycomb or lattice structure. In some embodiments, the bottom support may be provided on one or both side ends of the modular border, may also be provided in a middle section of the curb, or may extend along the entire length of the curb section of the modular border. It is to be appreciated that other types of rigidity panels providing structural support to the curb are contemplated in accordance with some embodiments of the present invention.

In some embodiments, the curb can include one or more curb face supports preventing deformation of the curb face. For example, and without limitation, curb 20 can include curb face supports 53. In some implementations, the curb face supports can engage the curb face and the curb back wall. In some implementations, the curb face supports can engage the curb face and the bottom rigidity panel. For example, and without limitation, curb 20 can include curb face supports engaging curb face 23 and curb back wall 25 and/or curb face supports engaging curb face 23 and bottom rigidity panel 55. In some implementations, the curb face supports can be in the form of an elongate rod or brace. In some other implementations, and as shown in the exemplary illustrations, the curb face support can be in the form of an elongate panel extending along the entire length of the curb section of the modular border.

The modular border can include one or more openings or holes. In some embodiments, the openings may permit retaining means to be inserted therethrough and engaged with the surrounding environment. In some implementations, the planter bottom wall may have an opening. For example, and without limitation, modular border 10 can include opening 77 in planter bottom wall 37. It is to be appreciated that any number of openings for receiving a retaining means may be provided in the planter bottom wall. It is also to be appreciated that the openings may be provided in various locations along the planter bottom wall, for example and without limitation, near the ends and/or in the middle section of the planter bottom wall. In some embodiments, the openings in planter bottom wall may be circular, however it is to be appreciated that the openings may have other shapes in accordance with some embodiments of the present invention. For example, and without limitation, the openings in the bottom planter section may be triangular, or may be in the form of elongate slots.

In some implementations, the opening for receiving retaining means may be provided in a lip. For example, and without limitation, border 10 may include one or more lips 71 having openings 72 therein. In some embodiments, the lip can be in the form of a tab. However, it is to be appreciated that the lip can be provided substantially along the entire length of the modular border. For example, and without limitation, the lip can be provided along the entire front edge of the border. In some embodiments, the lip can be at a bottom portion of the curb front wall. However, it is to be appreciated that the lip can be at a bottom portion of the planter back wall or at side ends of the modular border. It is further to be appreciated that the modular border may include one or more lips at one or more areas. For example, and without limitation, the modular border can have an elongate lip along the entire front edge of the curb front wall and one or more lips in the form of tabs at opposing ends of the planter back wall. Other configurations are contemplated in accordance with some embodiments of the present invention.

In some embodiments, the openings may permit downward drainage of water from the planter. In some implementations, one or more drainage openings may be provided in the planter bottom wall. For example, and without limitation, openings 38 may be provided in planter bottom wall 37. In some implementations, the drainage openings may be in the form of serpentine openings. However in some other implementations the drainage openings may be in the form of elongate slots. The drainage openings may substantially extend the entire length of the planter bottom wall, or may have shorter lengths. In some other implementations, one or more drainage openings may be provided in the planter back wall. It is to be appreciated that drainage openings having other shapes are contemplated in accordance with some embodiments of the present invention. For example, and without limitation, the drainage openings may be circular.

The modular border can also include one or more channels or conduits. In some embodiments, the planter can include a conduit. For example, and without limitation, conduit 69 can be provided at a top portion of planter back wall 39. In some implementations, the conduit can be in the form of a partial cylinder and may extend the entire length of the modular border. For example, and without limitation, conduit 69 can have a "C"-shaped configuration and run the entire length of planter back wall 39. However, it is to be appreciated that the conduit may be in the form of a solid cylinder. It is also to be appreciated that the conduit can only partially extend the length of the modular border and that modular borders can have multiple conduits. For example, and without limitation, a four foot modular border can include three (3) evenly spaced six inch conduit sections at a top portion of the planter back wall. It is to be appreciated that one or more conduits can be provided elsewhere in accordance with some embodiments of the present invention. For example, and without limitation, a modular border can include a conduit on the curb back wall and/or on a middle portion of the planter back wall.

In some implementations, landscape irrigation such as a drip water line can be inserted into conduit 69 such that it can be retained therein by compressive forces. For example, and without limitation, conduit 69 can have a diameter of about one-quarter inch, and drip polytubing having a diameter of one-quarter inch can be inserted therein. In some other examples, conduit 69 can have a diameter of about one-half inch, and drip polytubing having a diameter of one-half inch can be inserted therein. It is to be appreciated that other conduit dimensions are contemplated in accordance with some embodiments of the present invention. It is further to be appreciated that the conduit can be substantially solid and one or more irrigation openings may be provided therein. For example, and without limitation, the conduit can be engaged to a water supply and openings in the conduit can direct water into the planter section. In some embodiments, the ends of conduits of adjacent modular borders may sealably engage each other. For example, and without limitation, a conduit may include an end with a watertight connector such as an interference connector, a screw-on connector, a quick-disconnect connector, and the like, with or without a sealing ring or member.

In some embodiments, the curb can include a channel extending therethrough. In some implementations, the channel can be partially bound by one or more curb face supports. For example, and without limitation, channels 63 can be formed between adjacent curb face supports 53. In some implementations, channels 63 can be partially bound by curb front wall 21, curb face 23, curb back wall 25, and/or bottom support panel 55. In some implementations, the channel can be bound by one or more walls of the bottom support panel. For example, and without limitation, channels 65 can be formed between walls of bottom support panel 55. It is to be appreciated that electrical cabling (such as, for example and without limitation, low voltage landscape lighting) and/or irrigation (such as, for example and without limitation, drip polytubing) can be inserted through the curb channel.

In some embodiments, the curb face can include an opening therein for receiving a device therethrough. For example, and without limitation, curb face 23 may include one or openings (not illustrated). In some embodiments, the openings may be circular for receiving a circular portion of a device. However, it is to be appreciated that other shapes are contemplated in accordance with some embodiments of the present invention. In some embodiments, the openings may be in the form of "knock-out" or "punch-out" scoring such that a user can selectively create the opening. In some embodiments, one or more covers may be provided in the opening so as to visibly obscure the opening. For example, and without limitation, the covers may be hingedly attached to curb face 23. In some examples, the covers may be slidably attached to curb face 23. It is to be appreciated that other covers are contemplated in accordance with some embodiments of the present invention.

In some implementations, a landscape illumination device can be inserted through the opening. For example, and without limitation, an illumination device can have a support rod with a light fixture at a distal end thereof. The opening in the curb face can be sized and configured to receive a proximal end of the support rod such that the illumination device may be secured in the curb face. In some implementations, the light fixture may be a low voltage light, and the lighting device may be electrically connected through electrical cabling disposed in the curb channels (for example, and without limitation, curb channel 63 and/or curb channel 65). In some other implementations, the light fixture may be solar powered. It is to be appreciated that other illumination devices are contemplated in accordance with some embodiments of the present invention. It is also to be appreciated that in some embodiments, a hinged cover in the opening may be displaced when a support rod of the illumination device is inserted downwards into the opening of the curb face.

In some implementations, an irrigation device can be inserted through the opening. For example, and without limitation, an irrigation riser can extend upward through curb 20 and extend through an opening in curb face 23. In some implementations, a "pop-up" sprinkler can be positioned below the opening in the curb face such that, when pressurized, the head of the sprinkler can extend through the opening in curb face 23. It is to be appreciated that other irrigation devices are contemplated in accordance with some embodiments of the present invention.

In advantageous embodiments of the present invention, the modular curb can include at least one coupling member for engaging adjacent modular curbs. In some embodiments, a coupling member may be provided on the curb. In some embodiments, a coupling member may be provided on the border. In some embodiments, one or more coupling members may be provided on each the curb and the border.

Figure 2:
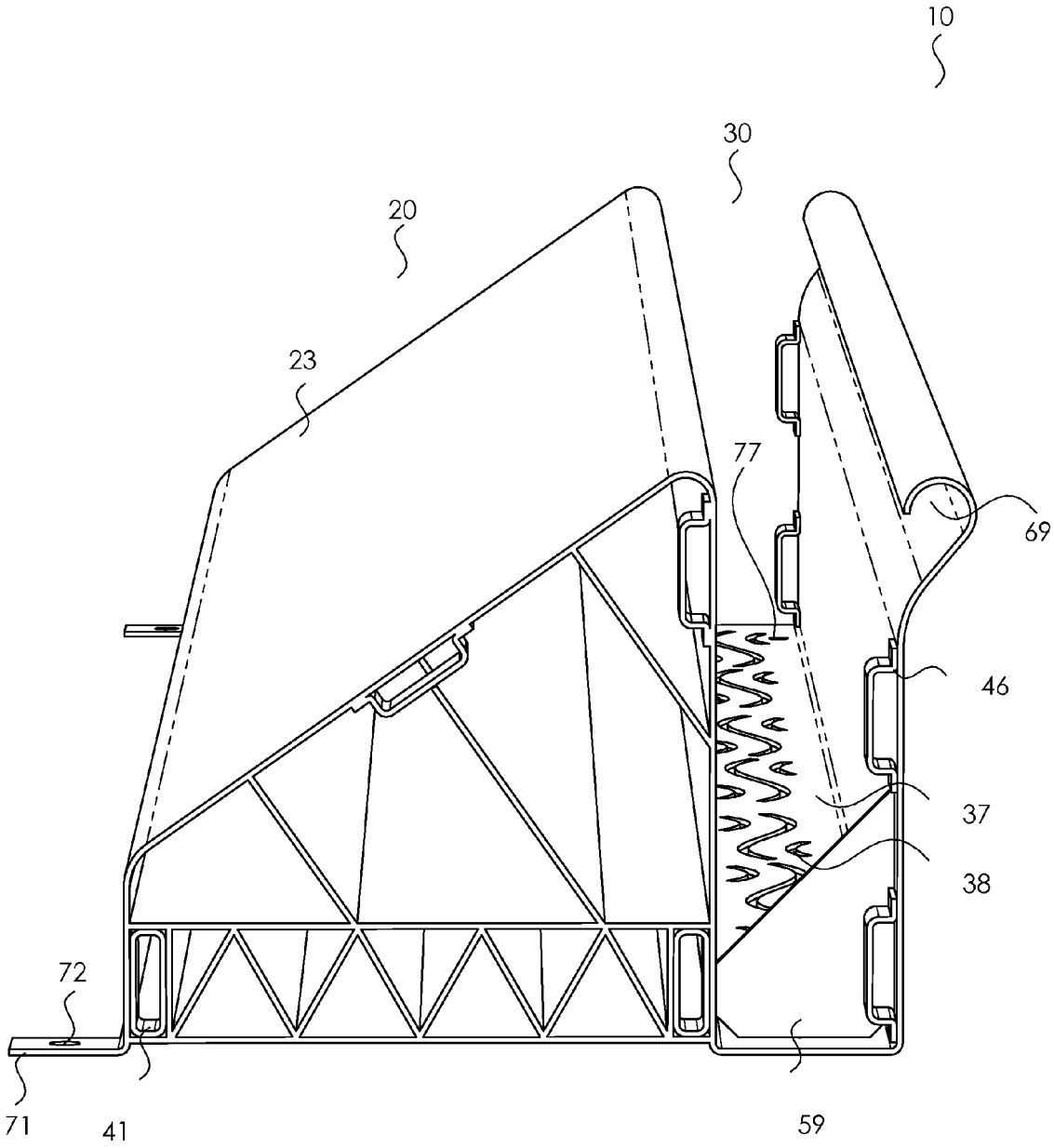
FIG. 2 is a perspective diagram illustrating an exemplary modular border in accordance with some embodiments of the present invention.
Figure 3:
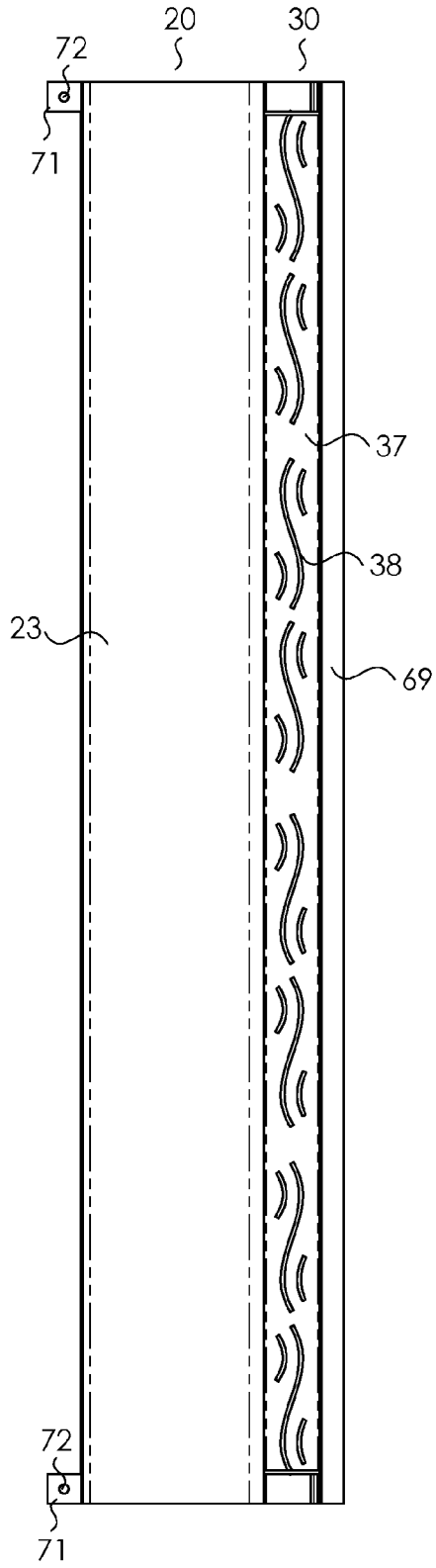
FIG. 3 is a top view diagram illustrating the exemplary modular border of FIG. 2 in accordance with some embodiments of the present invention.
Figure 4:
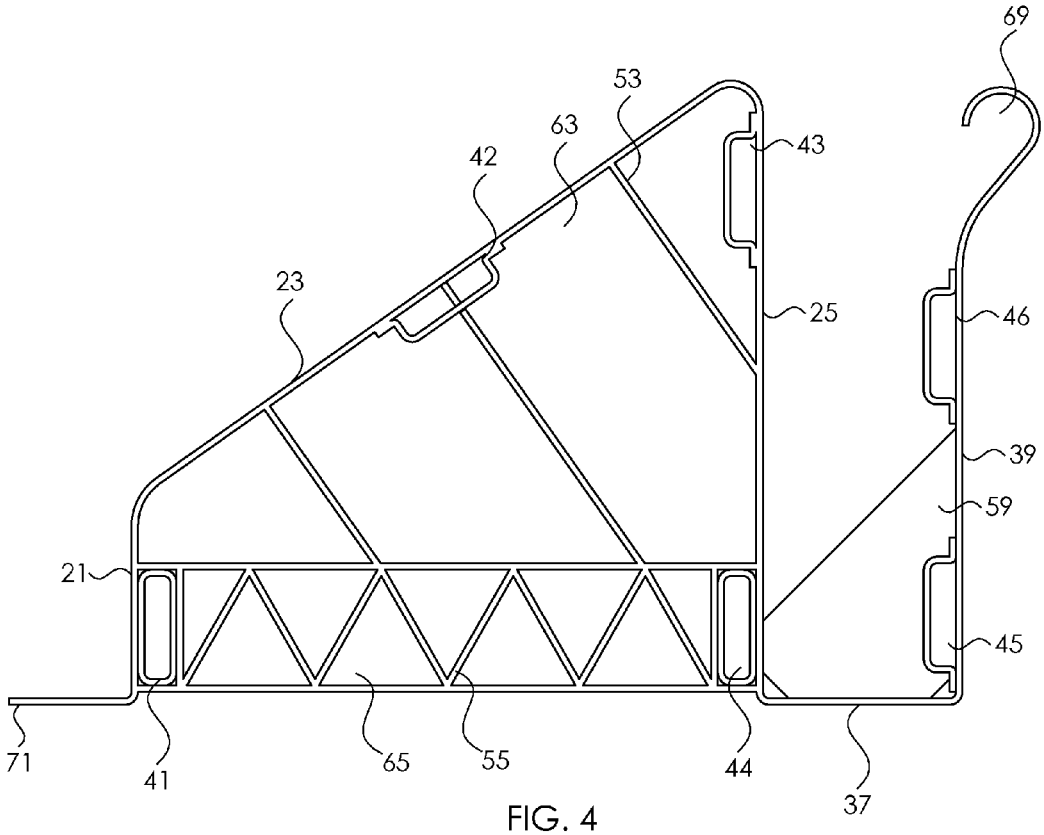
FIG. 4 is a side view diagram illustrating the exemplary modular border of FIG. 2 in accordance with some embodiments of the present invention.

Referring to the exemplary illustrations of FIGS. 2-4, for example and without limitation, coupling member 41 may be provided adjacent or integral with curb face 21 and/or bottom support panel 55. Coupling member 42 may be provided adjacent to or integral with curb face 23 and/or curb face support 53. Coupling member 43 may be provided adjacent to or integral with curb back wall 25 and/or curb face support 53. Coupling member 44 may be provided adjacent to or integral with curb back wall 25 and/or bottom support panel 55. Coupling member 45 may be provided to or integral with planter bottom wall 37, planter back wall 39, and/or planter support 59. Coupling member 46 may be provided adjacent to or integral with planter back wall 39. It is to be appreciated that any number of coupling members may be provided in accordance with some embodiments of the present invention. For example, and without limitation, each end of a modular border may include one coupling member on the curb front wall and one coupling member on the planter back wall. As discussed herein, in some embodiments a modular border may be secured to adjacent modular borders by the coupling members. Thus, it is to be appreciated that in some embodiments the placement of coupling members should be such that opposing sides of a modular border have coupling members in corresponding locations. For example, as illustrated in FIG. 2, and without limitation, modular border 10 may have coupling member 46 on a first side end and have a second coupling member on the opposing side end.

In some embodiments, the coupling members can be female-style coupling members having an opening or internal cavity therein. In some embodiments, the coupling members can be male-style coupling members having an extension or protrusion on a distal end thereof. A modular border may comprise all female coupling members, all male coupling members, or combinations thereof. In some implementations, a coupling member can have a generally rectangular shape. For example, and without limitation, coupling members 41-46 may have generally rectangular openings. However it is to be appreciated that one or more coupling members may have other shapes in accordance with some embodiments of the present invention. For example, and without limitation, the coupling members may have oval, rounded, or squared shapes. It is also to be appreciated that, in addition to female or male style coupling members, other types of coupling members are contemplated. For example, and without limitation, the coupling members may comprise magnetic, snap-fit, latching, screwing, bolting, or clamping style coupling members.

As above, some preferred embodiments of the present invention enable adjacent modular borders to be engaged to each other. Thus, in some embodiments, opposing sides of a modular border may have complementary coupling members. For example, and without limitation, a modular border may include female coupling members on a first side end and male coupling members on the opposing side end. In some other examples, (i) a first side end of a modular border may have a female coupling member on a curb front wall and a male coupling member on a planter back wall and (ii) the opposing side end of the modular border may have a male coupling member on the curb front wall and a female coupling member on the planter back wall. It is to be appreciated that other configurations are contemplated in accordance with some embodiments of the present invention.

In some embodiments, the coupling members can include barbed features. For example, and without limitation, a female-style coupling member may have one or more barbs, ridges, or rings on a surface of an internal cavity. In some other examples, a male-style coupling member may have one or more barbs, ridges, or rings on a surface of a protrusion. It is to be appreciated that other barbed features are contemplated in accordance with some embodiments of the present invention. For example, and without limitation, the barbed features can be in the form of hooks, loops, or eyelets.

It is to be appreciated that complementary coupling members of adjacent modular borders can include complementary features. For example, and without limitation, a female-style coupling member of a first modular border may have ridges on a surface of an internal cavity thereof and a male-style coupling member of a second, adjacently disposed modular border may include complementary ridges thereon. The barbed features of the female-style coupling member and the barbed features of the male-style coupling member may be complementary such that disengagement of the modular border sections is restrained.

It is to be appreciated that, in accordance with some embodiments of the present invention, modular borders may be provided in varying lengths for customizing the dimension of a landscape border design. In some embodiments, landscape border systems can include numerous modular borders having varying lengths. For example, and without limitation, rectangular modular borders having one, two, and four foot lengths can be provided. However, in some other embodiments, landscape border systems can include modular borders having a standardized length, and the modular border may be "cut to fit".

Figure 6:
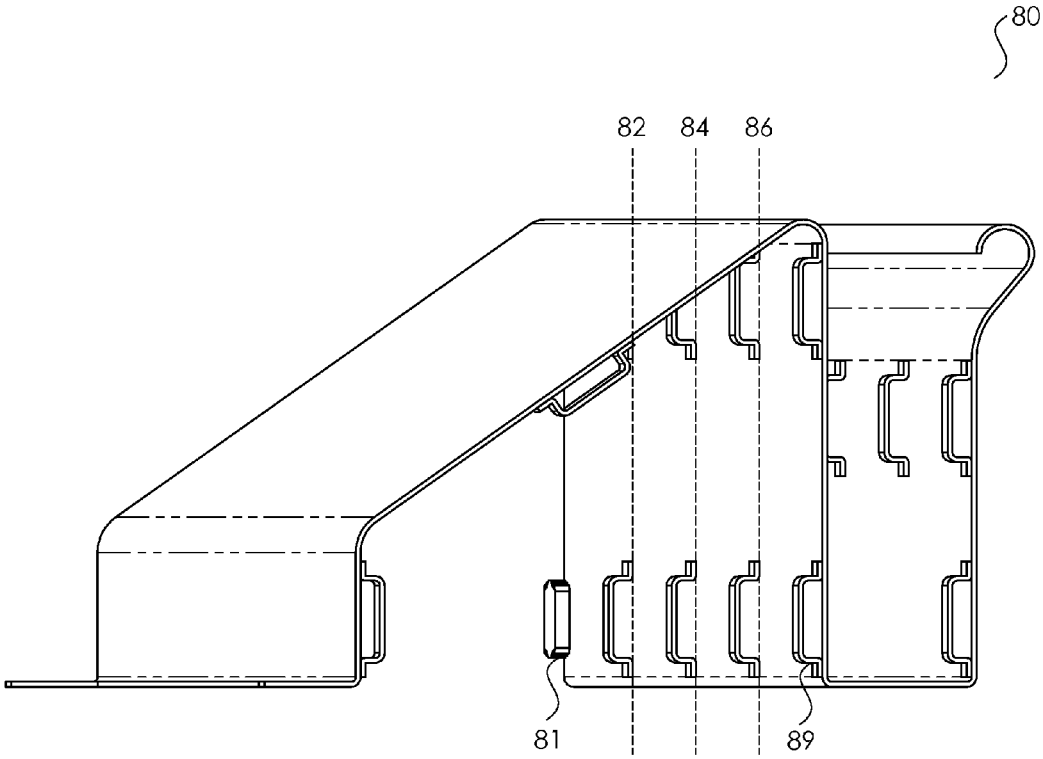
FIG. 6 is a perspective view diagram illustrating an exemplary modular border in accordance with some embodiments of the present invention.
Figure 7:
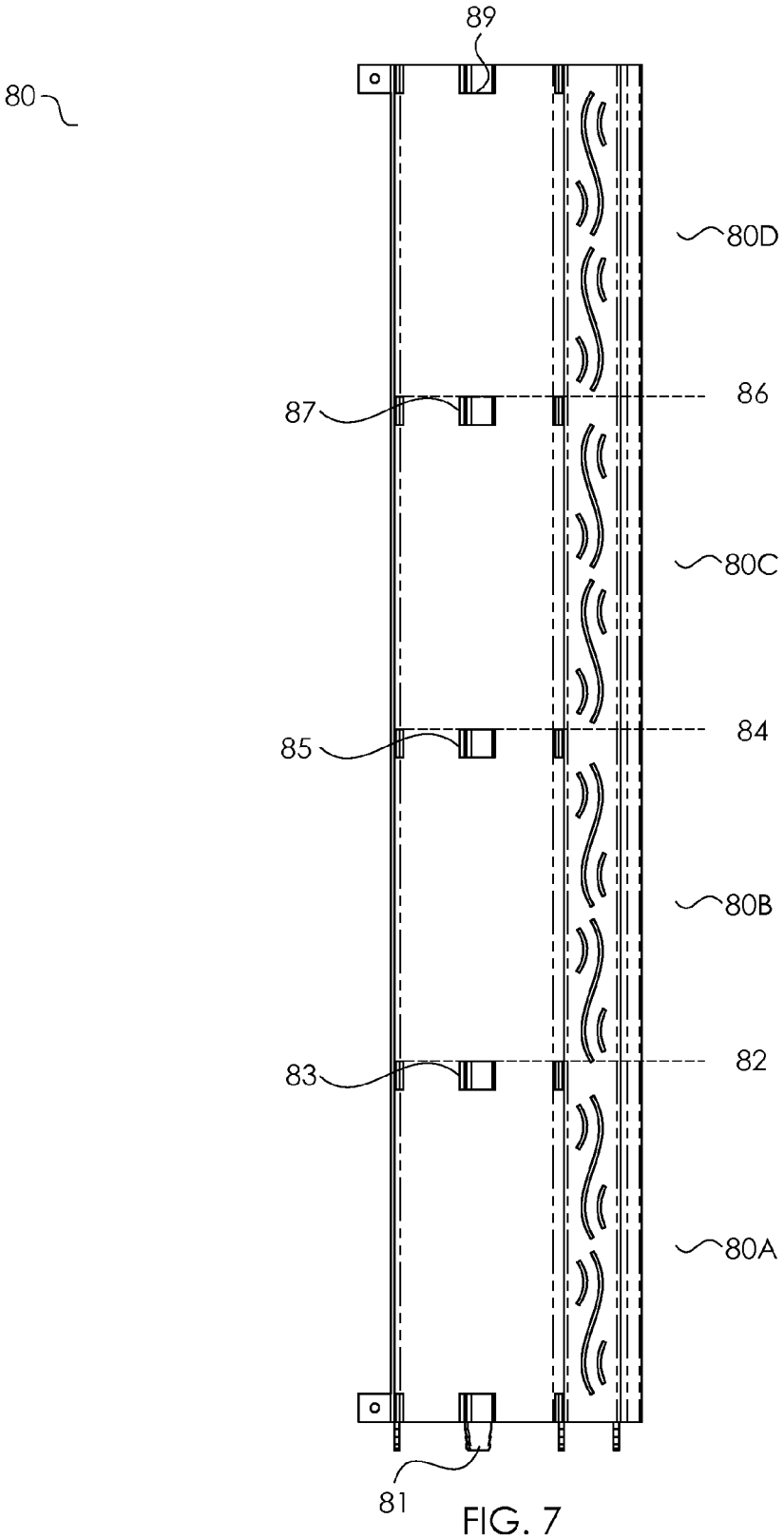
FIG. 7 is a bottom view diagram illustrating the exemplary modular border of FIG. 6 in accordance with some embodiments of the present invention.

Referring now to the exemplary illustrations of FIGS. 6-7, in some embodiments, modular borders may be divided into one or more partitions along one or more partition lines. In some implementations, the partition lines may be about tangential to the curb and planter. For example, and without limitation, modular border 80 may be divided into partitions 80A, 80B, 80C, and 80D along partition lines 82, 84, and 86, respectively. In some implementations the partition lines may be physically scored enabling the modular border to be divided by applying a separating force thereto. In some other implementations the partition lines may be marked such that a user can cut along the partition line, for example and without limitation, with a hacksaw.

In some examples, modular border 80 may have a length of four feet and partition lines 82, 84, and 86 may be located one, two, and three feet from a proximal end thereof. It can be appreciated that in such example, a single modular border may have a maximum length of four feet, or may be cut down to a length of one foot, two feet, or three feet. In some other examples, a modular border may have a length of two feet, and may be divided into six inch, twelve inches, and sixteen inch partitions. In some other examples, a one hundred and eighty degree circularly shaped modular border may be angularly partitioned at thirty, forty five, sixty, ninety, one hundred and twenty, one hundred thirty five, and one hundred fifty degrees. It is to be appreciated that modular borders may be partitioned into other lengths and/or dimensions in accordance with some embodiments of the present invention to enable custom fit and sized modular borders.

In some embodiments at least one coupling member may be provided adjacent to a partition line such that the distal, cut end of the modular border may be engaged to an adjacent modular border. For example, and without limitation, modular border 80 may include coupling member 83 near partition line 82, coupling member 85 near partition line 84, and coupling member 87 near partition line 86. It is to be appreciated that, in some examples and without limitation, coupling member 81 may comprise a male-style coupling member and coupling members 83, 85, 87, and 89 may comprise female-style coupling members. Coupling member 81 may have complementary features to each coupling members 83, 85, 87, and 89. It is to be appreciated that in some examples, modular border 80 can be divided along partition line 82 providing a custom sized modular border comprising partition 80A, which can be engaged to adjacent modular border sections on a proximal end through coupling member 81 and a distal end through coupling member 83. Other configurations are contemplated in accordance with some embodiments of the present invention. In some implementation, coupling members can be provided on both proximal and distal sides of a partition line thusly enabling utilization of both portions of a divided border (e.g., division of a single modular border into two smaller modular borders each having coupling members on distal ends thereof).

Exemplary Modular Landscape Border Systems

In some aspects, the invention concerns a modular landscape border system that can include at least two modular borders. Each border can include (i) a curb having a front wall, a face, and a back wall, (ii) a planter having a back wall and a bottom wall, and (iii) a coupling member which can be on the curb and/or the planter. The curb face can be between a top portion of the curb front wall and a top portion of the curb back wall, and the planter bottom wall can be between a bottom portion of the curb back wall and a bottom portion of the planter back wall. The first modular border can be secured to the second modular border by engaging the first border coupling member to the second border coupling member.

In some embodiments, the first border coupling member can be a female-style coupling member and the second border coupling member can be a male-style coupling member. As shown in the exemplary illustration of FIG. 1, for example and without limitation, modular border 11 may be secured adjacent to modular border 12 by the engagement of male-style coupling members 16 on modular border 12 to female-style coupling members (not visible) on modular border 11. In some embodiments, the coupling member can have complementary and/or barbed features. For example, coupling members 16 of modular border 12 may have barbed features on a protrusion thereof for securing coupling members 16 into female-style coupling members on a corresponding side of modular border 11.

In some embodiments, both the first border coupling member and the second border coupling member can be female-style coupling members, and the system may further include a male coupling member adapter. For example, and without limitation, modular border 10 and modular border 11 may each include female-style coupling members (not visible), and may be adjacently engaged with male coupling member adapter 17. It is to be appreciated that the male coupling member adapter can have a first end for insertion into the female-style coupling member of modular border 10 and a second end for insertion into the female-style coupling member of modular border 11. As shown in the exemplary illustration of FIG. 5A, for example and without limitation, male coupling member adapter 47 may have two ends each having protrusions for insertion into complementary female-style coupling members (such as coupling member 43 as shown in the exemplary illustration of FIG. 4). In some embodiments, the coupling members and/or the coupling member adapters may have barbed features.

Figure 5C:
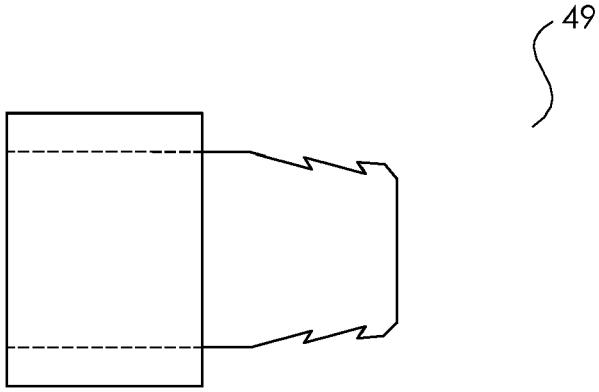
FIGS. 5A-5C are diagrams illustrating exemplary coupling member adapters in accordance with some embodiments of the present invention.
Figure 5A:
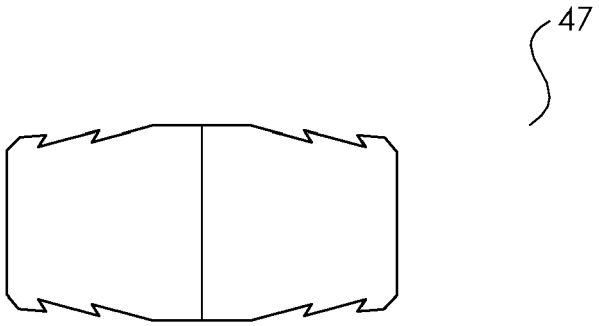
Figure 5B:
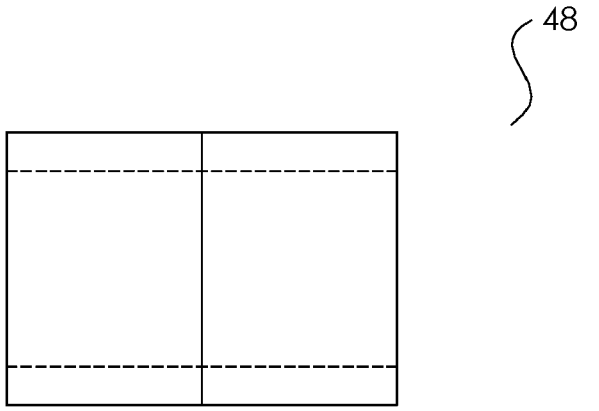

In some embodiments, both the first border coupling member and the second border coupling member can be male-style coupling members, and the system may further include a female coupling member adapter. Each end of the female coupling member adapter may include features complementary to features of the first border coupling member and the second border coupling member, respectively. For example, and without limitation, female coupling member adapter 48 as illustrated in FIG. 5B may have two ends each having openings for receiving complementary male-style coupling members. In some embodiments, the coupling members and/or the coupling member adapters may have barbed features.

It is to be appreciated that other combinations of coupling members and/or coupling member adapters for engaging adjacent modular border sections are contemplated in accordance with some embodiments of the present invention. For example, and without limitation, adjacent modular border sections may be directly engaged through integral coupling members and/or may be engaged through coupling member adapters. In some embodiments, systems may further include male-to-female coupling member adapters (for example, and without limitation, coupling member adapter 49 as illustrated in the example of FIG. 5C), which may also have barbed features.

The present invention provides modular landscape border apparatuses and systems that include both curb and planter sections, and which enable customization of landscape border dimensions. It is to be understood that variations, modifications, and permutations of embodiments of the present invention may be made without departing from the scope thereof. It is also to be understood that the present invention is not limited by the specific embodiments, descriptions, or illustrations or combinations of either components or steps disclosed herein. Thus, although reference has been made to the accompanying figures, it is to be appreciated that these figures are exemplary and are not meant to limit the scope of the invention.

What is claimed is:

1. A modular landscape border comprising:

a) a curb having a front wall, a face, a back wall, and a face support, said curb face positioned between a top portion of said curb front wall and a top portion of said curb back wall, said curb face support extending diagonally between said curb face and said curb back wall;

b) a planter having a back wall and a bottom wall, said planter bottom wall positioned between a bottom portion of said curb back wall and a bottom portion of said planter back wall;

c) a conduit positioned above a top edge of said planter back wall; and d) at least one coupling member, wherein one of said coupling members is on an end of one of the group consisting of said curb and said planter.

2. The border of claim 1, said planter further comprising a planter back wall support, said planter back wall support extending diagonally between said planter back wall and one of the group consisting of said curb back wall, said planter bottom wall, and combinations thereof.

3. The border of claim 2, wherein said planter back wall support does not substantially extend along the entire length of the planter back wall.

4. The border of claim 2, wherein said planter back wall support extends diagonally between said planter back wall and said planter bottom wall.

5. The border of claim 1, said curb further comprising at least one bottom support panel engaged with said curb front wall and said curb back wall.

6. The border of claim 1, further comprising at least one drain in said planter bottom wall.

7. The border of claim 1, further comprising at least one opening in said curb face for receiving an illumination device therethrough.

8. The border of claim 1, further comprising at least one opening in said curb face for receiving an irrigation device therethrough.

9. The border of claim 1, further comprising at least two coupling members, wherein a first of said coupling members comprises a female coupling member.

10. The border of claim 9, wherein a second of said coupling members comprises a male coupling member, said male coupling member and said female coupling member having complementary features.

11. The border of claim 1, further comprising at least two coupling members, wherein a first of said coupling members comprises a male coupling member.

12. The border of claim 1, further comprising a partition line about tangential to said curb and said planter along which said border can be separated into two partitions, wherein one of said at least one coupling member is adjacent to said partition line.

13. The border of claim 1, wherein said conduit comprises a partial cylinder.

14. The border of claim 1, wherein said curb face is sloped.

15. A modular landscape border system comprising at least two modular landscape borders, each of a first and a second border comprising (i) a curb having a front wall, a face, a back wall, and a face support, said curb face positioned between a top portion of said curb front wall and a top portion of said curb back wall, said curb face support positioned between said curb face and said curb back wall, (ii) a planter having a back wall, a bottom wall, and a back wall support, said planter bottom wall positioned between a bottom portion of said curb back wall and a bottom portion of said planter back wall, said planter back wall support positioned between said planter back wall and said planter bottom wall, and (iii) a coupling member, wherein said first border coupling member is engagable to said second border coupling member to secure said first border adjacent to said second border.

16. The border system of claim 15, wherein each of said first border coupling member and said second border coupling member are on one of the group consisting of said curb, said planter, and combinations thereof.

17. The system of claim 15, wherein said first border coupling member comprises a female coupling member.

18. The system of claim 17, wherein said second border coupling member comprises a male coupling member, and wherein said female coupling member and said male coupling member have complementary features.

19. The system of claim 17, wherein said second border coupling member comprises a female coupling member, said system further comprising a male coupling member adapter comprising:

a) a first end having features complementary to features of said first border female coupling member; and, b) a second end having features complementary to features of said of said second border female coupling member.

20. The system of claim 15, wherein each said first border coupling member and said second border coupling member comprise male coupling members, said system further comprising a female coupling member adapter comprising:

a) a first end having features complementary to features of said first border male coupling member; and b) a second end having features complementary to features of said second border male coupling member.

21. The border system of claim 15, further comprising, on each of said borders, a partition line about tangential to said curb and said planter along which said border can be separated into two partitions, wherein said coupling member is adjacent to said partition line.

22. The border system of claim 15, further comprising, on each of said borders, a conduit positioned above a top edge of said planter back wall.

23. The border of claim 15, wherein said planter back wall support does not substantially extend along the entire length of the planter back wall.

24. A modular landscape border system comprising:

a) a curb defined by a front wall, a sloped curb face, a curb back wall, and a curb face support, said curb face positioned between a top portion of said curb front wall and a top portion of said curb back wall, said curb face support positioned between said curb face and said curb back wall;

b) a planter defined by a back wall a bottom wall, and a back wall support, said planter bottom wall positioned between a bottom portion of said curb back wall and a bottom portion of said planter back wall, said planter back wall support positioned between said planter back wall and said planter bottom wall;

c) a first coupling member;

d) a second coupling member;

e) a coupling member adapter separate from said first coupling member and said second coupling member, said coupling member adapter comprising a first end having features complementary to features of said first coupling member, and a second end having features complementary to features of said second coupling member, and f) a partition line about tangential to said curb and said planter, wherein said first coupling member is adjacent to said partition line.

25. The modular landscape border system of claim 24, further comprising:

g) at least one conduit positioned above a top edge of said planter back wall, said conduit comprising a partial cylinder.

26. The modular landscape border system of claim 24, further comprising:

g) at least one bottom support panel engaged with said curb front wall and said curb back wall.

27. The modular landscape border system of claim 24, further comprising at least one opening in said curb face for receiving one of the group consisting of an illumination device and an irrigation device therethrough.

28. The modular landscape border system of claim 24, further comprising:

g) at least one serpentine drain in said planter bottom wall.

29. A modular landscape border comprising:

a) a curb having a front wall, a sloped face, and a back wall, said curb face positioned between a top portion of said curb front wall and a top portion of said curb back wall;

b) a planter having a back wall and a bottom wall, said planter bottom wall positioned between a bottom portion of said curb back wall and a bottom portion of said planter back wall;

c) a first coupling member on an end of one of the group consisting of said curb and said planter;

d) a second coupling member on an inside surface of one of the group consisting of said curb and said planter; and e) a partition line about tangential to said curb and said planter along which said border can be separated into two partitions, wherein said second coupling member is adjacent to said partition.

30. The modular landscape border of claim 29, said curb further comprising a face support extending diagonally between said curb face and said curb back wall, and said planter further comprising a back wall support extending diagonally between said planter back wall and said planter bottom wall, said planter back wall support not substantially extending along the entire length of the planter back wall.

* * * * *